US006272831B1

(12) United States Patent
Okamoto

(10) Patent No.: US 6,272,831 B1
(45) Date of Patent: Aug. 14, 2001

(54) YARN END RETRIEVING DEVICE AND OPERATING CART MOUNTING THE SAME

(75) Inventor: Akira Okamoto, Jouyou (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 09/295,420

(22) Filed: Apr. 21, 1999

(30) Foreign Application Priority Data

Aug. 31, 1998 (JP) ..... 10-245569

(51) Int. Cl.[7] ..... D01H 13/26

(52) U.S. Cl. ..... 57/261; 57/87; 57/262; 28/294

(58) Field of Search ..... 57/261, 262, 87; 28/294

(56) References Cited

U.S. PATENT DOCUMENTS 3,664,109 * 5/1972 Escursell-Prat ..... 57/34 R
4,478,035 * 10/1984 Pons ..... 57/262
5,005,348 * 4/1991 Stahlecker ..... 57/87
5,687,461 * 11/1997 Kohlen ..... 28/294

FOREIGN PATENT DOCUMENTS 8-245081 9/1996 (JP) .

* cited by examiner

*Primary Examiner*—John J. Calvert
*Assistant Examiner*—Shaun R Hurley
(74) *Attorney, Agent, or Firm*—Armstrong, Westerman, Hattori, McLeland & Naughton, LLP

(57) ABSTRACT

Airflows A1, A2 of compressed air are generated along a predetermined guiding surface 9, and directed against the yarn layer surface F of a package, causing the yarn end to be retrieved. A high-speed airflow A1 from the compressed air, and an accompanying airflow A2 which is pulled along with the high-speed airflow A1 lift the yarn end E from the yarn layer surface F. The yarn end E can be guided and retrieved with airflow A1, making use of the Coanda effect along the guiding surface 9. Accordingly, a yarn end can be easily and reliably retrieved using a low-capacity compressor.

3 Claims, 11 Drawing Sheets

YARN END RETRIEVING DEVICE AND OPERATING CART MOUNTING THE SAME

FIELD OF THE INVENTION

The present invention relates to a yarn end retrieving device, and in particular to a retrieving device employed when retrieving a yarn end on a package or bobbin.

BACKGROUND OF THE INVENTION

Conventionally, a suction mouth has been known as a yarn end finding device that retrieves a yarn end on a package or bobbin (hereinafter referred to as a "package") (Japanese Unexamined Patent Application Publication (Tokkai-Hei) No. 8-245081). This device uses air suction to retrieve the yarn end, and it brings a suction orifice into close proximity to the yarn layer surface of the package while air is sucked in from the suction orifice at the end of the suction mouth.

In order to retrieve the yarn end using only air suction, however, a comparatively high-capacity compressor must be employed. Additionally, it is necessary to generate strong suction force and enable the suction orifice to be positioned as close as possible to the yarn layer surface in order to prevent suction failures. However, as the suction orifice becomes more proximal to the yarn layer surface, the suction force increases. Thus, it has been difficult to hold the suction mouth at a constant position against the suction force. If the suction orifice adheres to the yarn layer surface, it becomes impossible to retrieve the yarn end.

It is thus an object of the present invention to solve these problems by providing a yarn end retrieving device which is able to easily retrieve a yarn end using a low-capacity compressor.

SUMMARY OF THE INVENTION

In order to accomplish this object, a yarn end retrieving device which retrieves a yarn end by generating an airflow of compressed air along a predetermined guiding surface, and directing the airflow against a yarn layer surface.

Thus, a high-speed airflow from the compressed air and an accompanying airflow which is generated from air pulled along with the high-speed airflow causes the yarn end to be lifted off the yarn layer surface, and an airflow which uses the Coanda effect along the guiding surface guides and retrieves the yarn end.

The guiding surface may be comprised of a flat surface section and a curved surface section.

It is preferable that a pair of guiding surfaces be provided and that the curved surface sections are arranged so as to face each other so as to form an interstice of a predetermined distance, and such that the air currents are blown in opposing directions from each of the flat surface sections towards each of the curved surface sections.

DETAILED DESCRIPTION OF THE PREFERRED EMBODIMENTS

The preferred embodiment of the present invention will now be explained using the accompanying drawings.

Figure 1:
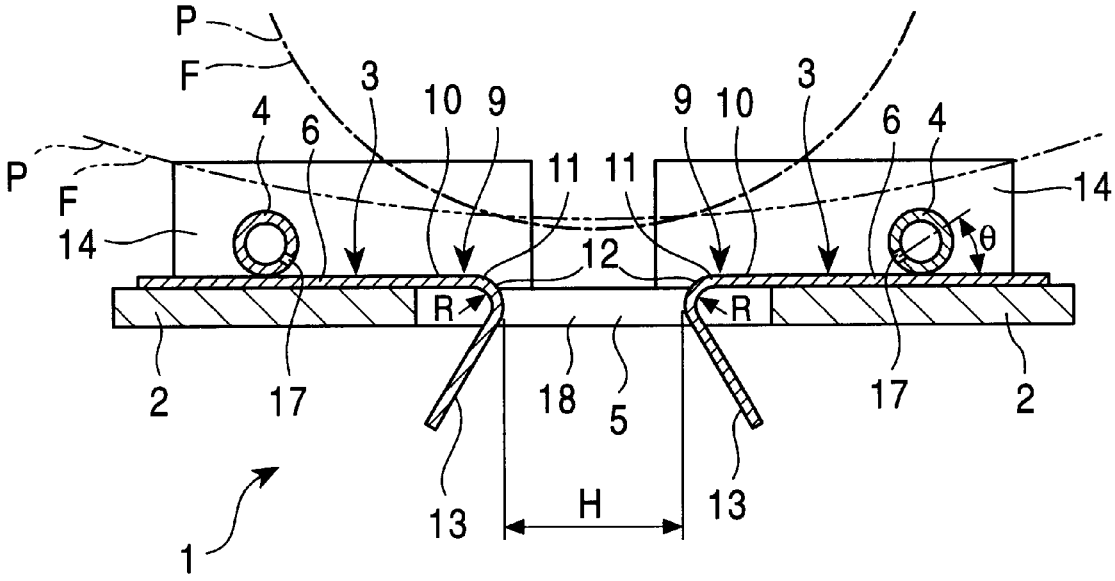
FIG. 1 is a cross-section front view of a first embodiment of the yarn end retrieving device of the present invention.
Figure 2:
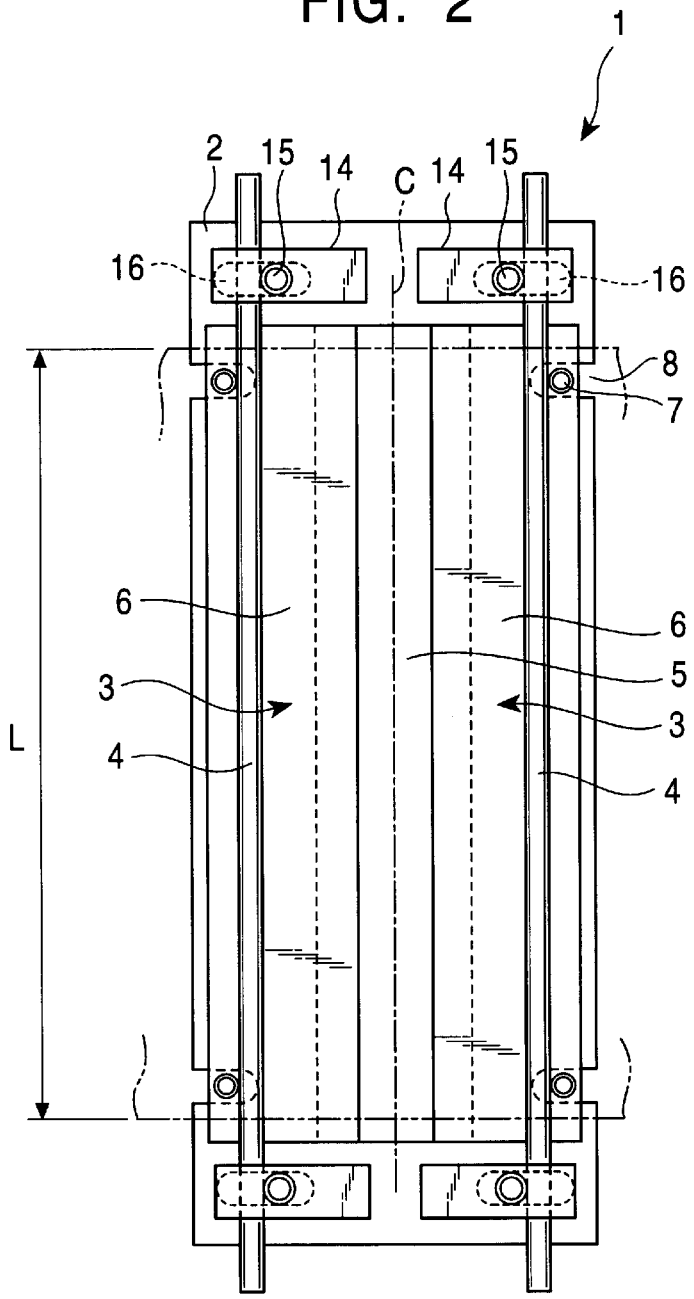
FIG. 2 is a plan view of the first embodiment of the yarn end retrieving device of the present invention.

As shown in FIG. 1 and FIG. 2, a yarn end retrieving device 1 is principally comprised of a pair of plate-shaped members 3 arranged on the surface of a base plate 2, and of nozzles 4 arranged on the surface of each plate-shaped member 3. P is a package, and two different packages with different diameters are depicted.

The base plate 2 is formed as a relatively thick, rectangular, flat plate provided with a rectangular opening 5 in the middle. The length of the opening 5 is formed so as to be longer than the length L in the axial direction C of the central axis C of the package P.

The plate-shaped members 3 are formed as rectangular, flat plates which are relatively thinner than the base plate 2, and the plate-shaped members 3 are formed such that they are the same length as the openings 5. The plate-shaped members 3 are arranged apart from each other in a direction perpendicular to the central axis C of the package P. The facing end of each plate-shaped member 3 is bent, using a press-forming device or the like, such that it extends away from the package P, and is inserted into the opening 5. The flat sections 6 of each of the plate-shaped members 3 are overlaid on top of the base plate 2, and they are fixed to the base plate 2 with bolts (not shown in the drawing). Namely, a pair of screw holes 7 where bolts are fastened to the flat sections 6 are provided, and long holes 8 through which the bolts are inserted are provided in the base plate 2. The long holes 8 allow the positions of the plate-shaped members 3 to be adjusted relative to each other.

As will later become clear, the surfaces of the plate-shaped members 3 which face the package P become a guiding surface 9. The guiding surface 9 is formed of a continuous surface comprising a flat portion 10 formed by surfaces of the flat sections 6, and a curved portion 12 formed by surfaces of the curved sections 11. Additionally, a short, flat section 13 is formed at the end of each curved section 11, but since this section 13 is required for processing and does not help retrieve the yarn end, these sections 13 may be eliminated in some cases. The essential portion is the curvature R of the curved portions 12, and this curvature may be about 2~10 mm.

Thus, in each plate-shaped member 3, the curve surface sections 12 at one end of each flat surface section 10 are brought into close proximity to the yarn layer surface F of the package P, and curve smoothly away from the package P. The curved surface sections 12 are arranged facing each other separated by a predetermined distance, and an exhaust orifice 18 (an opening) is formed by this gap between the sections 12. The width H of the exhaust orifice 18 is ranged about 6 to 20 mm, for example.

Next, a pair of nozzles 4 are arranged on the flat surface sections 10 of each of the plate-shaped members 3, and the nozzles 4 extend in the axial direction C of the package P, and both ends of each nozzle 4 are inserted through and fixed to the supporting blocks 14 fixed on on the base plate 2. The supporting blocks 14 are provided with screw holes 15, and the base plate 2 is provided with long holes 16, and these holes 15, 16 are arranged so as to allow the position of the nozzles 4 relative to each other to be adjusted through a bolt assembly (not shown in the drawings).

Figure 3:
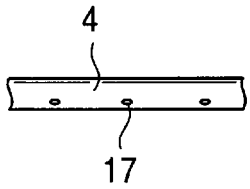
FIG. 3 is a sectional view of a nozzle.

Each of the nozzles 4 comprises a pipe member closed at one end, and compressed air is introduced from its open end so as to be ejected from a plurality of nozzle orifices 17. It should be noted that nozzle 4 may alternatively be comprised such that both ends of the nozzle 4 are open, with compressed air led out from both ends. As shown in FIG. 3, the nozzle orifices 17 are arranged at equal intervals along the length of the nozzles 4, and are distributed along the entire length of the plate-shaped members 3. The nozzles 4 are arranged so as to contact with the flat surface sections 10, and the nozzle orifices 17 are comprised so as to eject compressed air over the flat surface sections 10 towards the curved surface sections 12. It should be noted that may be arranged so that they are slightly separated from, and run parallel to the flat surface sections 10. Such an arrangement directs the air ejected by the nozzles 4 in relatively opposed directions from each of the flat surface sections 10 towards the curved surface sections 12. The angle θ between the direction in which air is ejected from the nozzles 17 and the flat surface sections 10 is ranged about 20 to 30 degrees. In addition, the compressed air is about 3 kg/cm$^2$, for example.

The operation of this embodiment of the present invention will now be explained.

First, as shown in FIG. 1, when the yarn end retrieving device 1 is activated, the exhaust orifice 18 is brought to the closest proximity of the yarn layer surface F of the package P. Since as shown in FIG. 2, the exhaust orifice 18 is rectangular in shape, with a length slightly longer than the axial length L of the package P. Thus, the exhaust orifice 18 can be made fairly close to the total length of package P.

Figure 4:
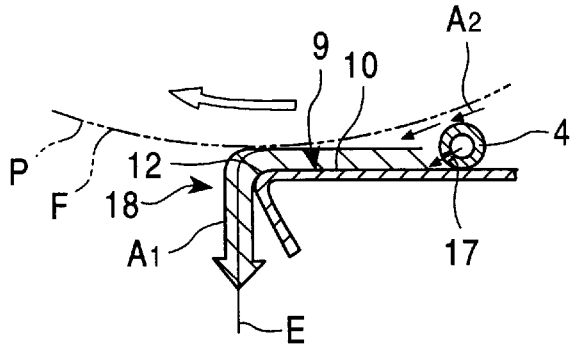
FIG. 4 is a front view showing a compressed air flow.

Next, when compressed air is supplied to the nozzle 4 from a compressor or the like (not shown in the drawings), the compressed air is simultaneously ejected from the nozzle orifices 17 as shown in FIG. 4.

The flow of the compressed air is blown along the flat surface sections 10 and the curved surface sections 12 due to the Coanda effect to form high-speed airflow A1, and this high-speed airflow A1 is exhausted from the exhaust orifice 18. An accompanying airflow A2 which is drawn along with the high-speed airflow A1 from the gap between the nozzle 4 and the yarn layer surface F is also generated. As the accompanying airflow A2 nears the high-speed airflow A1, it gradually picks up speed, finally merging with the high-speed airflow A1 and exiting through the exhaust orifice 18. Prior to merging, the accompanying airflow A2 flows along the yarn layer surface F and acts upon the yarn layer surface F, and then after merging, the high-speed airflow A1 flows along the yarn layer surface F and acts upon the yarn layer surface F.

When the package P is either manually or mechanically rotated, these airflows A1, A2 cause the yarn end attached to the yarn layer surface F to be lifted off the yarn layer surface F at an arbitrary location, and actively buoyed upwards. The floating yarn end E rides the high-speed airflow A1, and is pulled through the exhaust orifice 18, and retrieved. This complets the process of retrieving yarn end E.

Thus, as described above, the compressed airflows A1, A2 are generated along the predetermined guiding surface 9, and those airflows A1, A2 act upon the yarn layer surface F, causing the yarn end E to be retrieved. Consequently, the retrieval of the yarn end E can be reliably and easily performed using a low-capacity compressor.

In other words, because the yarn end attached to the yarn layer surface F is lifted out by the air that flows along the yarn layer surface F, the force of the airflow is able to operate directly on the yarn end. Thus, the retrieval of the yarn can be accomplished using less power than in the conventional suction methods in which the surplus air around the periphery of the suction orifice is also dragged along, and a smaller capacity compressor can be employed.

Additionally, since the space between the guiding surface 9 and the yarn layer surface F becomes pressurized to a higher pressure than the surrounding atmosphere due to the ejection of the compressed air, the two surfaces do not pull each other together, and if the entire device is operated by an appropriate force such that the guiding surface 9 and the yarn layer surface F come into close proximity, the gap between the two surfaces can be automatically held in equilibrium between the pressing force and the air pressure. In other words, automatic adjustment of the gap can be achieved, and the problems of maintaining the gap in the conventional suction methods, as well as failure to retrieve the yarn end can be avoided.

In the case of the present device, as the air pressure rises or the amount of airflow increases, highly effective yarn end retrieval can be expected. Thus, as described above, the ejection of air towards each other from the two nozzles 4 is effective. It should be noted, however, that it is also possible to perform air ejection from only one nozzle 4. In such case, the pulling force based on the viscosity of airflows A1 and A2, as shown in FIG. 4, enables the package P to be rotated, and makes external rotary driving of the package P unnecessary. It should also be noted that the air pressure can be adjusted depending upon the type of yarn being processed or the shape of the package.

In the present device, the position of nozzles 4 and the position of the plate-shaped members 3 are adjusted according to the outer diameter of the package P. This makes it possible to realize a layout best suited for the package P being processed. Additionally, by adjusting the curvature R of the curved surface sections 12, the direction of the airflow on the downstream side of the curved surface sections 12 can also be adjusted.

It may also be possible to use the present invention simultaneously with a conventional suction method. In other words, suction can be performed from the exit portion of the exhaust orifice 18, and the yarn end E can be sucked-out. For example, about −300 mmAq blower such as that employed by the innovative spinning frame disclosed in Japanese Unexamined Patent Application Publication (Tokkai-Hei) No. 8-245081, may be used in combination with the present invention to both transport and gather the retrieved yarn end.

Furthermore, in the present embodiment, the longitudinal direction of the yarn end retrieving device is arranged such that it matches the length of the package P, but the retrieval is possible even if the device is arranged differently. It is possible to arrange the package P and the device such that they cross at an arbitrary angle, or so that they are perpendicular to each other.

Figure 5:
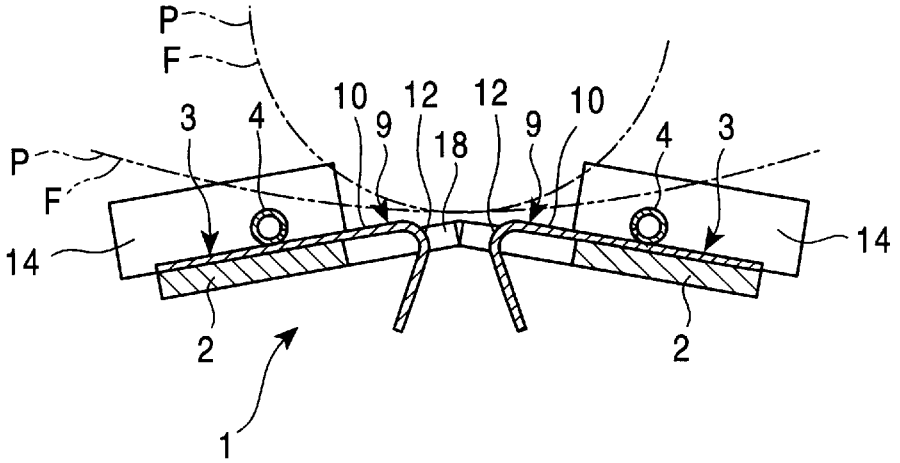
FIG. 5 is a cross-section front view of an alternate embodiment of a yarn end retrieving device of the present invention.

An alternate embodiment of the present invention will now be described. As shown in FIG. 5, the base plate 2 is comprised of two welded segments slanted so that they form a V-shape with the opening section 5 at the center. Similarly, the plate-shaped members 3 are arranged in the same V-shape, and the flat surface sections 10 are arranged so as to slant relative to each other at a predetermined angle.

With the previously described embodiment, since the entire unit is flat and the nozzles 4 protrude on the plate-shaped members 3, when either the curved surface sections 12 or the exhaust orifice 18 comes into proximity to the yarn layer surface F, there is a danger that the nozzles 4 will interfere with the yarn layer surface F. This is particularly true when the outer diameter of the package P is large. According to the present embodiment, however, the nozzles 4 are removed from the yarn layer surface F, and so do not interfere with the yarn layer surface F. Instead, the curved surface sections 12 or the exhaust orifice 18 are brought into proximity to the yarn layer surface F, achieving highly effective yarn end retrieval.

Figure 6:
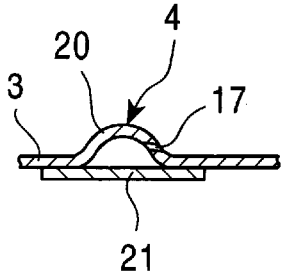
FIG. 6 is a cross-section front view of an alternate embodiment of a nozzle.

FIG. 6 shows an alternate embodiment of the nozzle 4. According to this embodiment, the nozzle 4 is comprised such that a groove section 20 is formed in the plate-shaped member 3, and a shut-off plate 21 is fixed to the plate-shaped member 3. The nozzle exit 17 is comprised of small holes formed in the groove section 20. Thus, the nozzle 4 may be formed in several different ways. For example, it may be possible to weld a pipe member directly to the flat surface sections 10.

Figure 7:
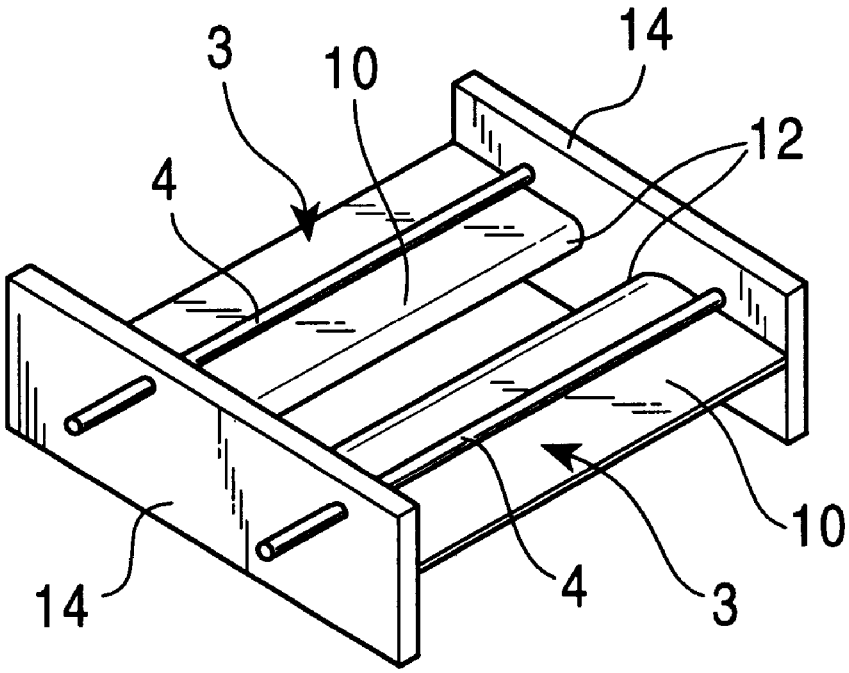
FIG. 7 is a perspective view of an alternate embodiment of a yarn end retrieving device of the present invention.

As shown in FIG. 7, the plate-shaped member 3 may be attached directly to a supporting block 14, and the base plate 2 may be eliminated. This enables the structure of the device to be simplified, and the cost to be reduced. Additionally, the supporting blocks 14 can be arranged such that they are separated in the direction of the central axis of the package P, and a pair of the plate-shaped members 3 and the nozzles 4 attached such that they bridge the resulting gap.

Various other embodiments may also be employed. For example, the surface of a block-shaped member may be employed for the guiding surface instead of using the plate-shaped member. Additionally, the present invention may retrieve the yarn end from not only the yarn layer surface of the package, but from any kind of yarn layer surface.

As thus comprised, the present invention can easily and reliably retrieve a yarn end using a small-capacity compressor.

Next, an embodiment of an operating cart of a spinning frame in which the yarn end retrieving device of the present invention is equipped will now be explained based on FIG. 8~FIG. 15.

First, the general structure of the spinning frame in which the operating cart of the present invention is arranged will be explained.

Figure 8:
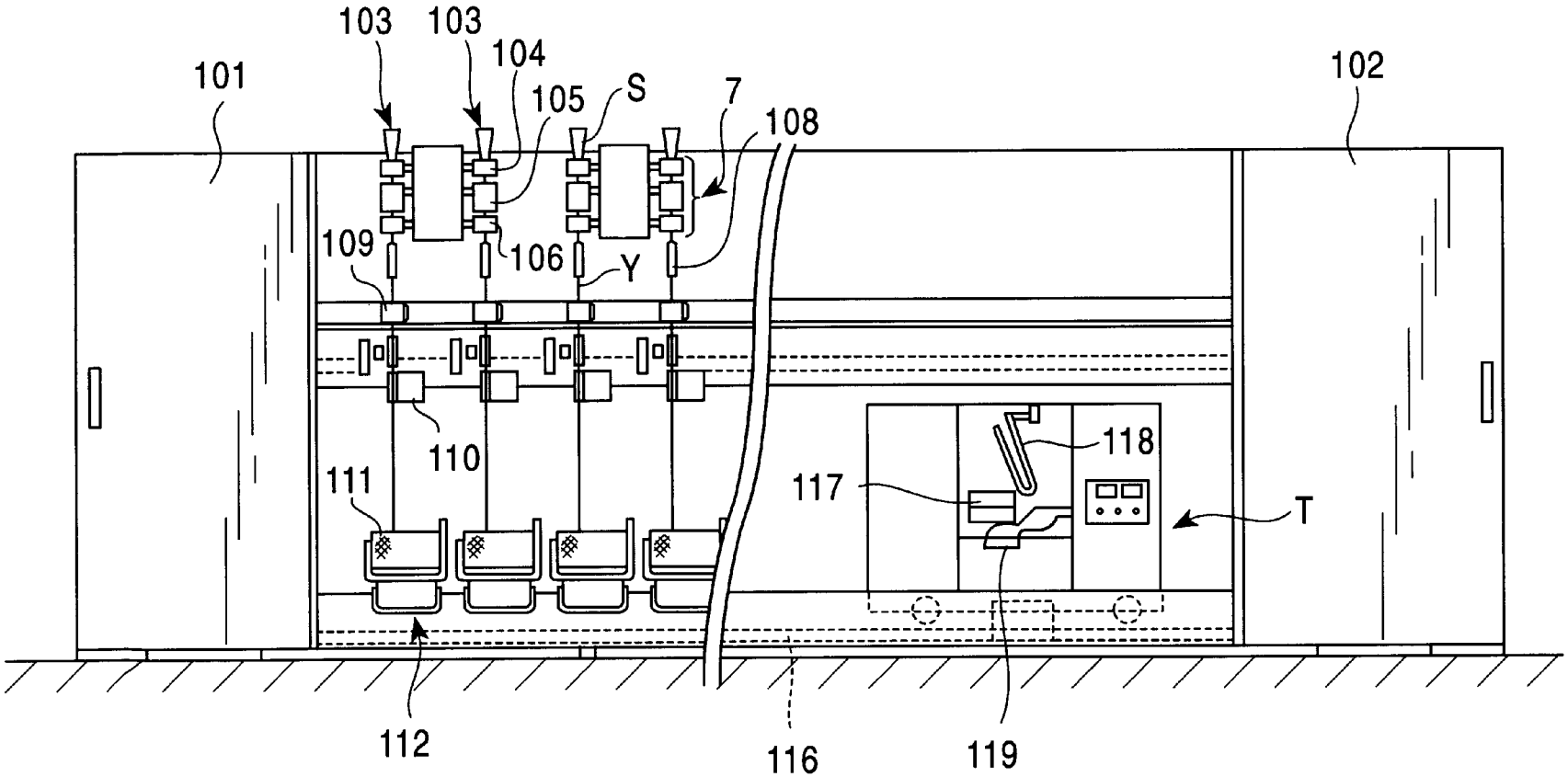
FIG. 8 is a front view of the entire spinning frame in which the yarn end retrieving device of the present invention is employed.
Figure 9:
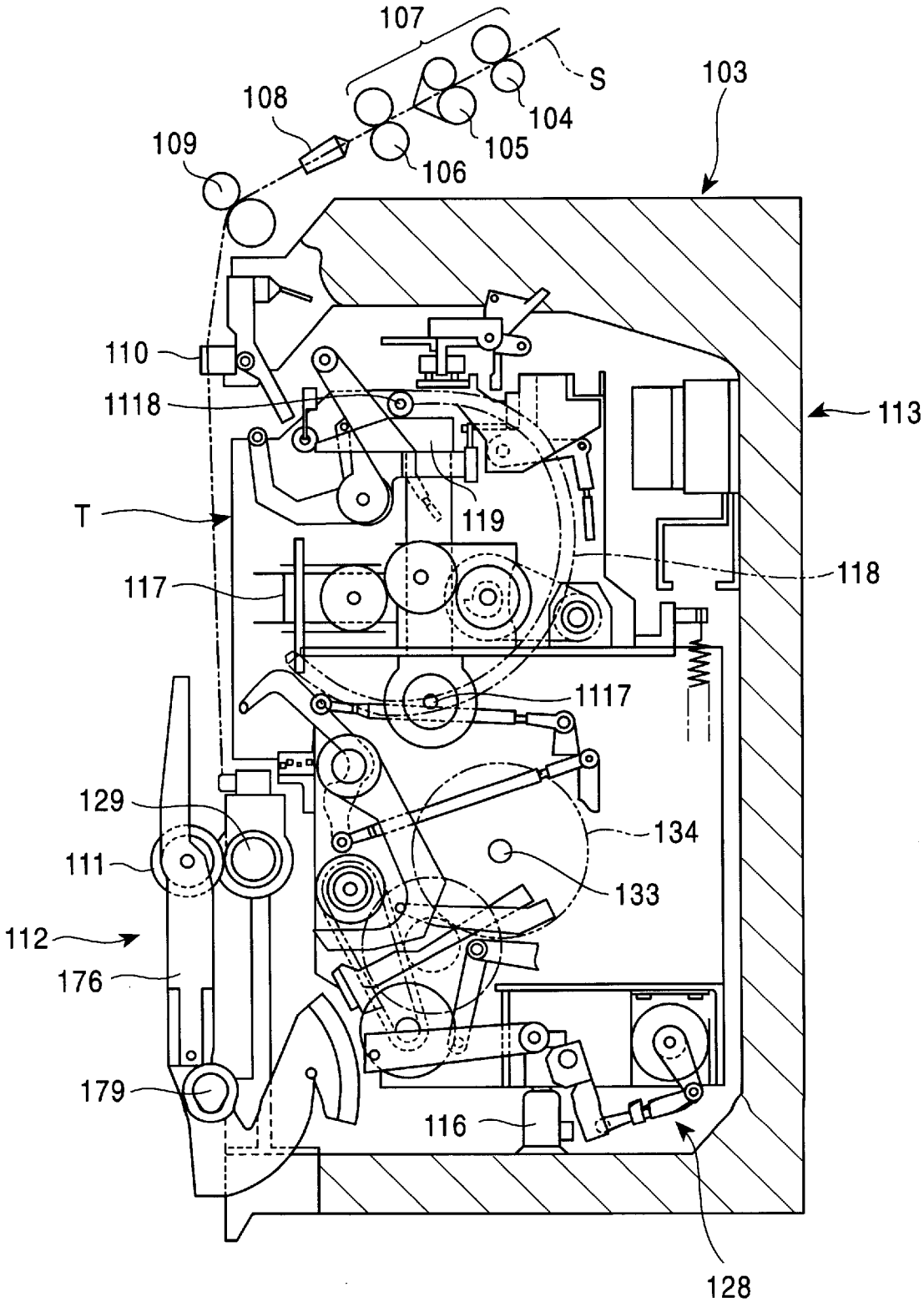
FIG. 9 is a side view of the entire machine shown in FIG. 8.

In FIG. 8 and FIG. 9, a plurality of spinning units 103 are arranged in rows between a motor box 101 and a blower box 102. Each spinning unit 103 is comprised of a drafting part 107 made up of a back roller 104, a mid-roller 105 and a front roller 106, an air ejection nozzle 108, a nip roller 109 which draws the spun yarn Y formed by the air ejection nozzle 108, a slub catcher 110 which detects thick portions of the spun yarn (hereinafter called "slubs"), and a winding part 112 which winds the yarn into a package 111 as the yarn is traversed.

As shown in FIG. 9, the spinning unit 103 is arranged on a frame 113 which forms a reversed C shape when viewed in the cross-section. A yarn joining cart T runs along a rail 116 inside the hollow of the frame 113. The cart T traverses laterally along the rail 116, as seen in FIG. 8.

The yarn joining cart T is provided with a yarn retrieval pipe 118 which holds onto the upper yarn (on the spinning side) using suction, and guides the upper yarn towards a knotting manism 117, and the yarn retrieving pipe 118 is rotatably centered around a rotating shaft 1118. The yarn joining cart T is also provided with an air blowing mouth 119, which comprises a compressed air type yarn retrieval device for retrieving the lower yarn (on the package 11 side), and guiding it towards the knotting mechanism 117. The air blowing mouth 119 is rotatably centered around a rotating shaft 1117.

Additionally, a sliver S supplied to the draft part 107 is drawn from sliver cans arranged behind the machine, and supplied to the back roller 104.

When there is a yarn breakage at one of the spinning units 103, the yarn joining cart T stops at the spinning unit 103 where the yarn breakage has occurred. Using the yarn retrieving pipe 118 and the air blowing mouth 119, it retrieves the upper yarn on the spinning side and the lower yarn on the package side, leads the yarns to the knotting mechanism 117 provided in the yarn joining cart T, and rejoins the yarns. The yarn joining cart T then moves towards the next spinning unit 103 where a yarn breakage has occurred.

The yarn joining cart T is also provided with a stopping mechanism 128 for stopping the yarn joining cart at the position of the spinning unit 103 at which a yarn breakage has occurred.

Further, a package 111 is attached to a cradle 176 and centered around a rotary shaft 179 so as to be indecently rotatable, and during normal winding, the package 111 contacts a friction roller 129 which rotates in a predetermined direction, and winds the spun yarn.

Each of these mechanisms is actuated by a respective cam groups 134, which are fixedly attached to a cam shaft 133.

The air blowing mouth 119 which retrieves the yarn end from the package 111 will now be described.

Figure 10:
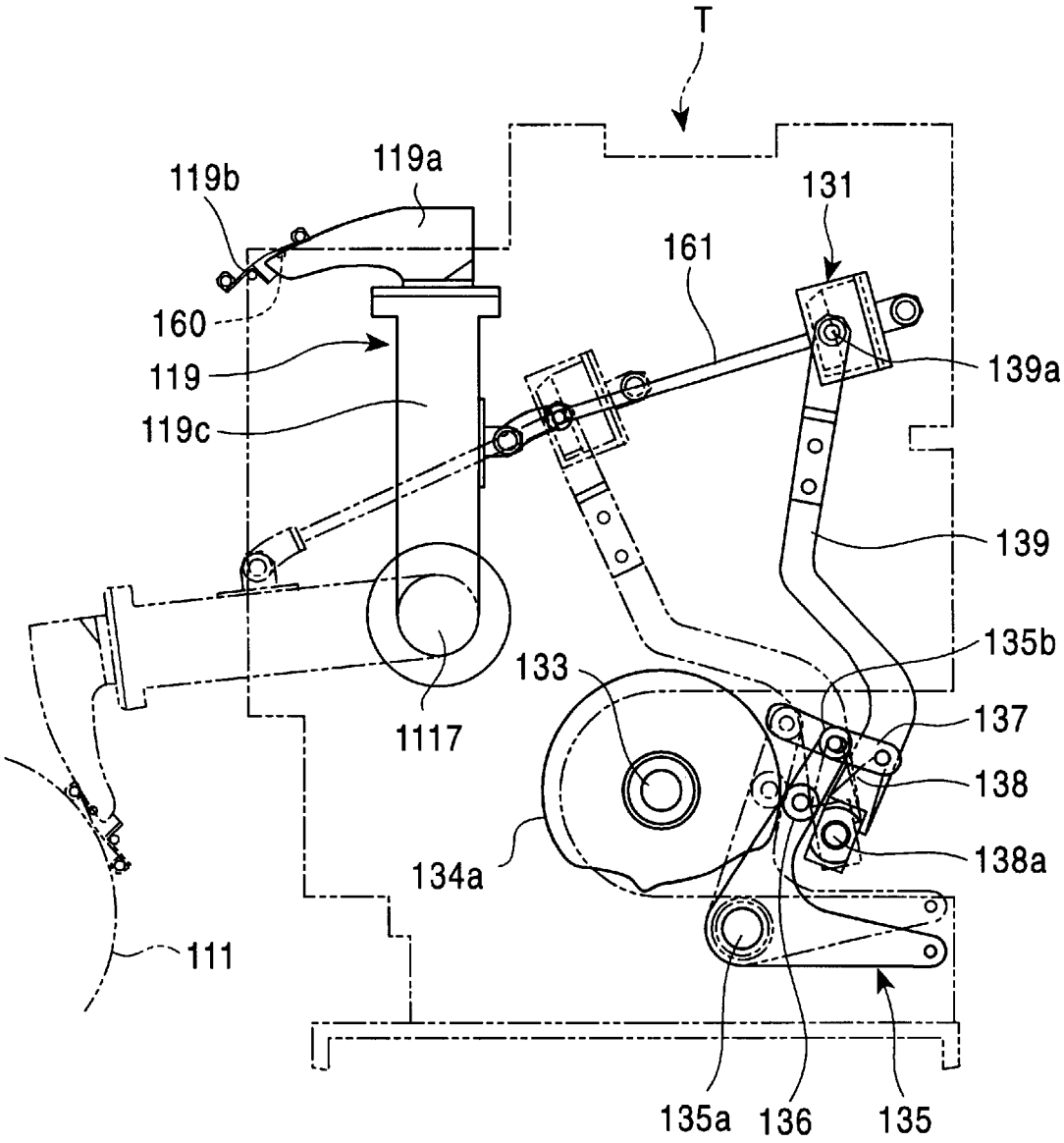
FIG. 10 is a plan view showing the operational structure of a compressed air type mouth.

As shown in FIG. 10, the air blowing mouth 119 is comprised so as to be rotatable around the rotating shaft 1117, and is normally held in the upright position indicated by the solid lines. During yarn end retrieval, the air blowing mouth 119 is rotated downward to the position indicated by the chain-dotted line. There, the end section 119*b* which is attached to the mouth body 119*a* of the air blowing mouth 119 so as to be rotatable via a supporting shaft 160, is brought into close proximity to the outer surface of the package 111, and the yarn retrieval is performed.

A driving arm 135 which is rotatable around a fulcrum 135*a* is arranged in close proximity to the cam shaft 133, and a roller member 136 which is rotatably affixed to the driving arm 135 abuts a mouth driving cam 134*a* which rotates integrally with the cam shaft 133. The driving arm 135 applies force in the direction in which the driving arm 135 abuts the mouth driving cam 134*a,* and rotates with the rotation of the mouth driving cam 134*a* to a corresponding position on the surface of the mouth driving cam 134*a*. The end 135*b* of the driving arm 135 is coupled to a link arm 138 which is rotatable around a central rotary shaft 138*a* via a link member 137. A lift arm 139 is fixed to the central rotary shaft 138*a* so as to integrally rotate with the link arm 138. The end of the lift arm 139 and the mouth arm 119*c* of the air blowing mouth 119 are coupled via a lifter 131.

Thus, when the driving arm 135 rotates with the rotation of the mouth driving cam 134*a,* the rotation of the lift arm 139, which is coupled via the link member 137 and the link arm 138, causes the air-blowing mouth 119, which is coupled to the lift arm 139 via the lifter 131, to rotate.

The structure of the end section 119*b* of the air blowing mouth 119 will now be explained.

Figure 11:
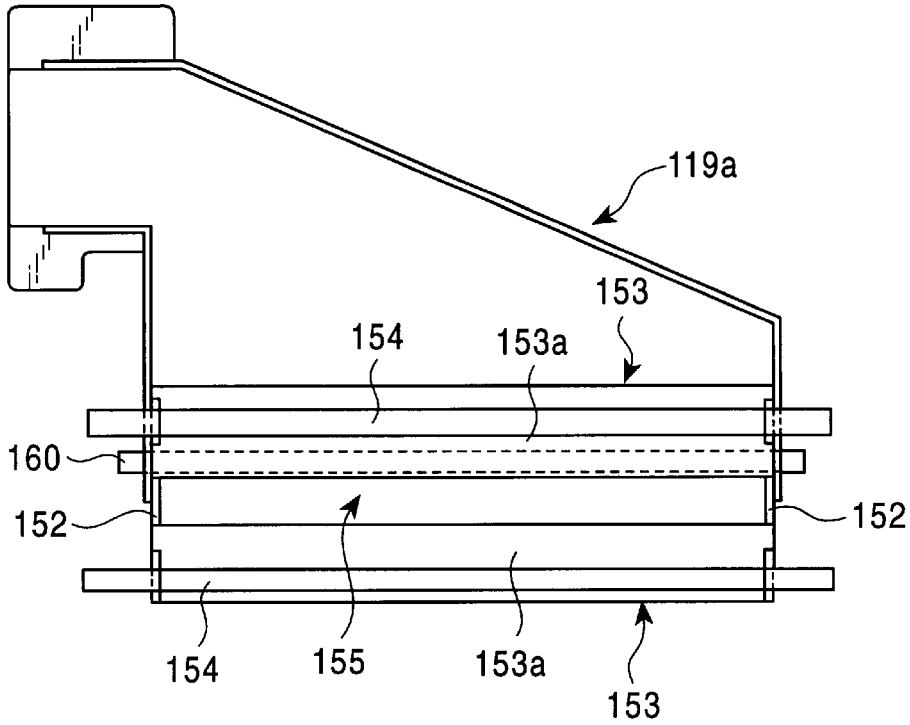
FIG. 11 is a plan view showing an end section of the compressed air type mouth.
Figure 12:
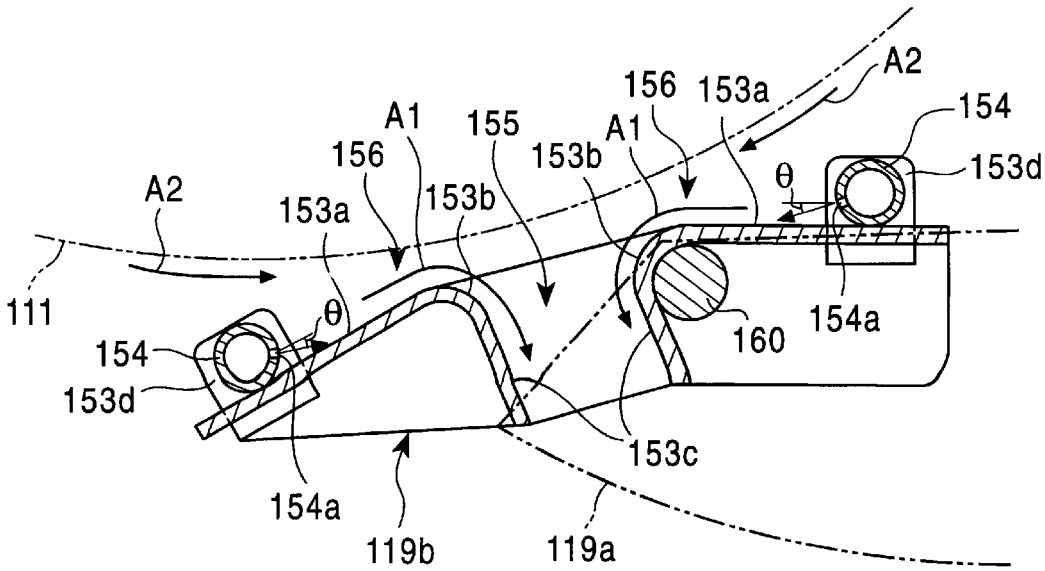
FIG. 12 is a side view of the mouth of FIG. 11.

As shown in FIG. 11 and FIG. 12, the end section 119*b* of the air blowing mouth 119 is coupled via coupling boards 152, 152 to a pair of opposedly arranged plate-shaped members 153, 153 and nozzles 154 are provided on the surface of each plate-shaped members 153, 153. The plate-shaped members 153, 153 are arranged at predetermined intervals, coupled at their lateral ends via the coupling members 152, 152, as shown in FIG. 11, and an opening section 155 is formed between the plate-shaped members 153, 153. The sude ends of the opening section 155 of the plate-shaped members 153 are curved away from the package 111 forming a tucked section 153*c,* and nozzle brackets 153*d,* 153*d* are formed on the flat surface section 153*a* of the plate-shaped members 153, 153, and the nozzles 154 are fixedly attached at the nozzle brackets 153*d,* 153*d*.

A curved surface section 153*b* provided with a fixed curvature is formed between the flat surface sections 153*a* of the plate-shaped members 153 and the tucked section 153*c,* and this curved section 153*b* and the flat surface section 153*a* together form a guiding surface 156. Additionally, a supporting shaft 160 is fixedly attached to the inside of the curved surface section 153*b* on one of the plate-shaped members 153, and the end section 119*b* is rotatably supported on the the mouth body 119*a* by means of the supporting shaft 160.

The nozzles 154 affixed to the flat surface sections 153*a* of the plate-shaped members 153 are formed from pipe shaped members, one end of which is obstructed. The compressed air is led into the other open end section, and the compressed air is then ejected from a plurality of the nozzle openings 154*a* formed at roughly equal intervals along the wall of the nozzle 154 on the side of the opening section 155. The nozzle opening 154*a* is provided at a position at which the ejection direction of the compressed air is inclined toward the flat surface section 153*a* side at a predetermined degree θ separate from a direction parallel to the the flat surface section 153*a* of the plate-shaped members 153. The compressed air ejected from the nozzle openings 154*a* follow toward the direction of the opening section 155 along the plate-shaped members 153.

As comprised above, when the compressed air is supplied to the nozzles 154 from a compressor (not shown in the drawings), the compressed air is simultaneously ejected from the nozzle openings 154*a* at the end section 119*b* of the air blowing mouth 119. The flow of the compressed air ejected from each of the nozzle openings 154*a* turns into the high-speed airflow A1 which runs along both the flat surface section 153*a* and the curved surface section 153*b* due to the Coanda effect of the airflow, and is exhausted from the opening section 155 to the counter package 111 side. In addition, accompanying airflow A2 which is pulled along with the first high-speed airflow A1 and drawn into an interstice between the yarn layer surface of the package 111 and the nozzle 154 is generated. This accompanying airflow A2 slowly increases in speed as it approaches the high-speed airflow A1, and then merges with the high-speed airflow A1 and is discharged from the opening section 155. Before the high-speed airflow A1 and the accompanying airflow A2 merge, the accompanying air flow A2 operates upon the yarn layer surface of the package 111 which is in close proximity to the guiding surface 156 of the yarn end section 119*b,* and after merging, the high-speed airflow A1 operates upon the yarn layer surface of the package 111 which is in close proximity to the guiding surface 156 of the yarn end section 119*b*.

The operation of both the high-speed airflow A1 and the accompanying airflow A2 cause the yarn end, which is attached to the yarn layer surface of the package 111 at an arbitrary location, to be lifted from the yarn layer surface, and floated up from the package 111 during the rotation of the package 111. The floating yarn end then travels on the high-speed airflow A1 from the opening section 155, and is pulled out and retrieved from the package 111.

Because the yarn end can not be retrieved when the guiding surface 156 of the air blowing mouth 119 adheres to the yarn layer surface on the outer surface of the package 111, in order to perform the yarn end retrieval by means of the air blowing mouth 119, an appropriate interstice must be provided between the guiding surface 156 and the outer surface of the package 111. However, the interstice formed between the guiding surface 156 and the peripheral surface of the package 111 is at a pressure higher than the atmospheric pressure due to the ejection of the compressed air. Therefore, the guiding surface 156 and the peripheral surface of the package 111 do not adhere to each other. Moreover, when pressing force is exerted against the air blowing mouth 119 such that the guiding surface 156 is brought into close proximity to the peripheral surface of the package 111, this pressing force is balanced by the force of the compressed air, thus naturally forming the interstice between the guiding surface 156 and the peripheral surface of the package 111.

Thus, the operation of the compressed airflow on the yarn layer surface of the package 111 by the air blowing mouth 119 retrieves the yarn end from the package 111. The force of the compressed airflow can thus operate directly upon the yarn end, and the yarn end retrieval can be performed using less power than when a suction mouth is used and excess peripheral air sucked in. This enables a smaller capacity compressor to be used.

Thus, by employing the air blowing mouth 119 as the yarn end retrieving device arranged on the operating cart T, blowers or driving motors need not be arranged in the operating cart T or on the machine side of the spinning frame, space can be reduced, energy can be conserved, and costs can be reduced.

The air blowing mouth 119 is equipped with a package brake function for forcibly stopping the package 111, which continues rotating due to inertia after the drive is discontinued. The package brake function of this air blowing mouth 119 will now be explained.

Figure 13:
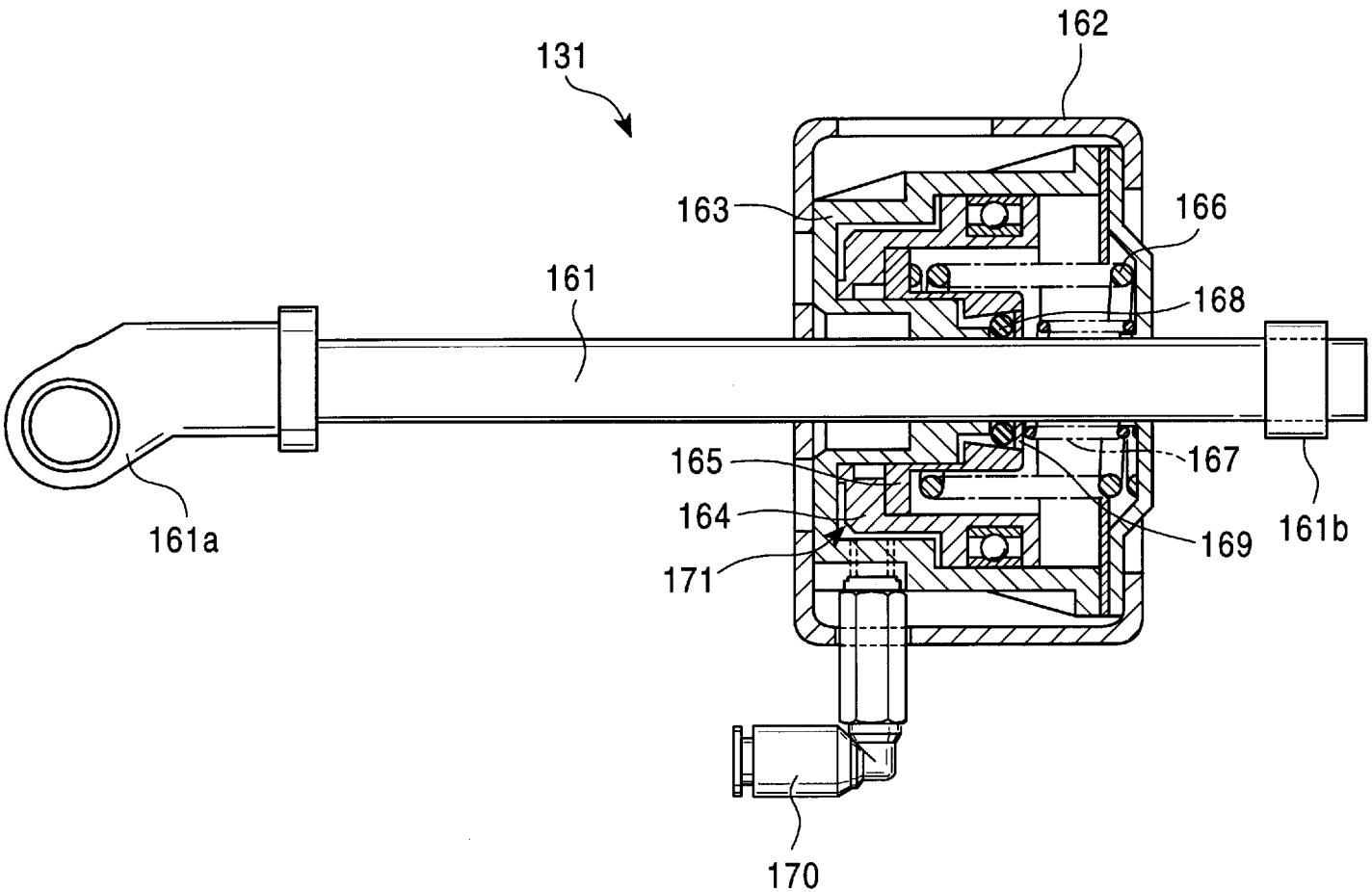
FIG. 13 is a cross-section side view of the lifter which rotates the compressed air type suction mouth.

As shown in FIG. 10 and FIG. 13, the lifter 131 which couples the air blowing mouth 119 to the mouth arm 139 is comprised primarily of a rod 161, a case 162, and a cylinder 163. One end 161*a* of the rod 161 is attached to the air blowing mouth 119, and the case 162 is attached to the mouth arm 139. The rod 161 fits through the case 162 and the cylinder 163, and a second piston 165 of the cylinder 163 is fixedly attached to the rod 161 via a plurality of bearing balls 168, 168.

The inner circumference of the second piston 165 is formed such that its diameter tapers inward toward one end 161*a* of the rod 161, and the bearing balls 168, 168 are pressurized by a washer 169 that is urged toward one end section 161*a* side of the rod 161 by means of a second spring 167. Thus, the outer surface of the bearing balls 168, 168 contact and exert force against the outer surface of the rod 161 and the inner circumference of the second piston 165. The second piston 165, the bearing balls 168, 168 and the rod 161 are all integrally coupled. Thus rod 161 is enabled to slide against a section beyond the pressure region of the bearing ball 168 and against the case 162.

Additionally an air joint 170 is connected to the cylinder 163, allowing the compressed air to be supplied through the hollow section 171 inside the cylinder 163. By supplying the compressed air to the hollow section 171, the second piston 165 which exerts force towards one side of the end section 161*a* of the rod 161 by means of the first spring 166 exerts force against the opposite end section 161*a* via the first piston 164 through the resistance to the force of the first spring 166. In this way, the second piston 165 moves towards the opposite end section 161*a,* and the rod 161 which is integrally coupled with the second piston 165 via the bearing balls 168, 168 moves forward the direction of the second piston 165.

In other words, by supplying the compressed air towards the hollow section 171 inside the cylinder 163, the rod 161 can slide to the right, as seen in FIG. 13, against the case 162. Thus, the distance between the air blowing mouth 119, which is coupled via the lifter 131 to the lift arm 139, and the lift arm 139 decreases.

For example, when the distance between the air blowing mouth 119 and the lift arm 139 decreases while the air blowing mouth 119 is lowered and the lift arm 139 is fixed in its rotated position, the air blowing mouth 119 is rotationally raised.

Thus, when a yarn end is retrieved from the package 111 when a yarn breakage occurs at a spinning unit 103, the air blowing mouth 119 operates as follows.

Figure 14:
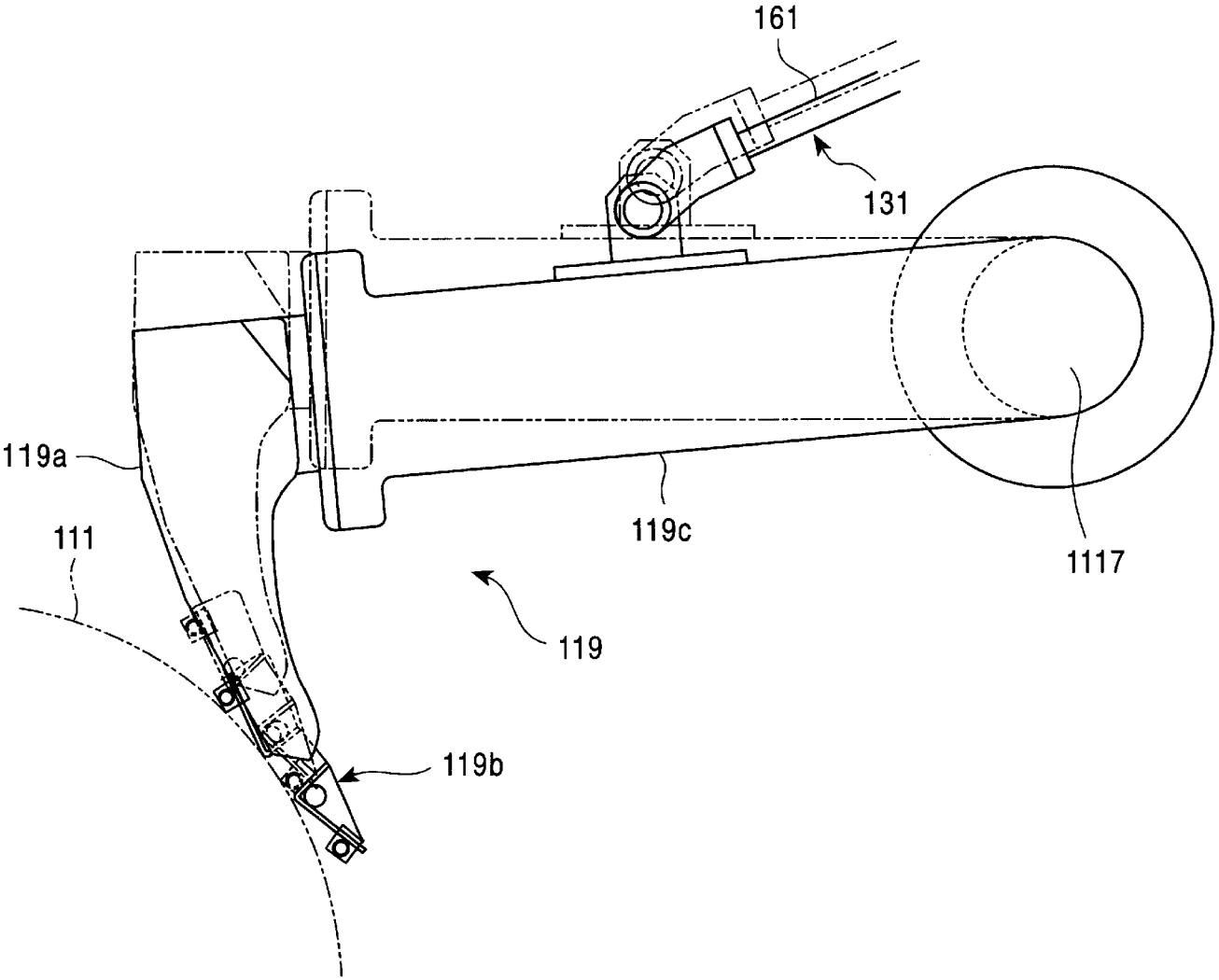
FIG. 14 is a diagram showing the package brake function of the compressed air type suction mouth.

When the air blowing mouth 119, which is in a raised position, is lowered to perform yarn end retrieval, the end section 119*b* of the air blowing mouth 119 is lowered until it contacts the outer surface of the package 111 as shown by the solid line in FIG. 14, in which the compressed air is not supplied inside the cylinder 163 of the lifter 131. The package 111 is rotationally driven until the yarn brakes. But even after rotational drive is stopped after the yarn breakage, the package 111 continues to rotate due to its inertia. By contacting the end section 119*b* to the yarn layer surface of the outer surface of the package 111, the end section 119*b* creates friction which forces the inertial rotation of the package 111 to stop.

After the inertial rotation of the package 111 is stopped, the compressed air is supplied inside the cylinder 163 of the lifter 131, the rod 161 is moved towards the lift arm 139 side, and the air blowing mouth 119 is moved slightly upward, as indicated by the chain-dotted line of FIG. 14.

Thus, an interstice is created between the end section 119*b* of the air blowing mouth 119 and the outer surface of the package 111. Since the end section 119*b* is attached to the mouth body 119*a* so as to be independently rotatable, ejection of the compressed air from the nozzles 154 causes an appropriate interstice to form between the guiding surface 156 of the end section 119*b* and the outer surface of the package 111, thus enabling yarn end retrieval by means of the air blowing mouth 119.

The device can be comprised such that when yarn end retrieval is performed, the air blowing mouth 119 is rotationally lowered until the end section 119*b* makes contact with the yarn layer surface on the outer surface of the package 111, generating friction which forcibly stops the inertial rotation of the package 111. This allows the rotation of the package 111 to be stopped without having to provide a package brake, and thus allows the amount of space which the spinning frame takes up to be reduced, and allows further cost reduction.

Additionally, although the pack 111 from which the yarn end is retrieved by the air blowing mouth 119 may have differing diameters depending upon the amount of yarn that is wound, the end section 119*b* of the air blowing mouth 119 is attached so as to be rotatable against the mouth body 119*a,* as described above. Therefore, the position of the end section 119*b* can be adjusted according to the diameter of the package 111, and the inertial rotation of the package 111 can be stopped regardless of the size of the diameter of the package 111, and then performs the yarn end retrieval.

Figure 15:
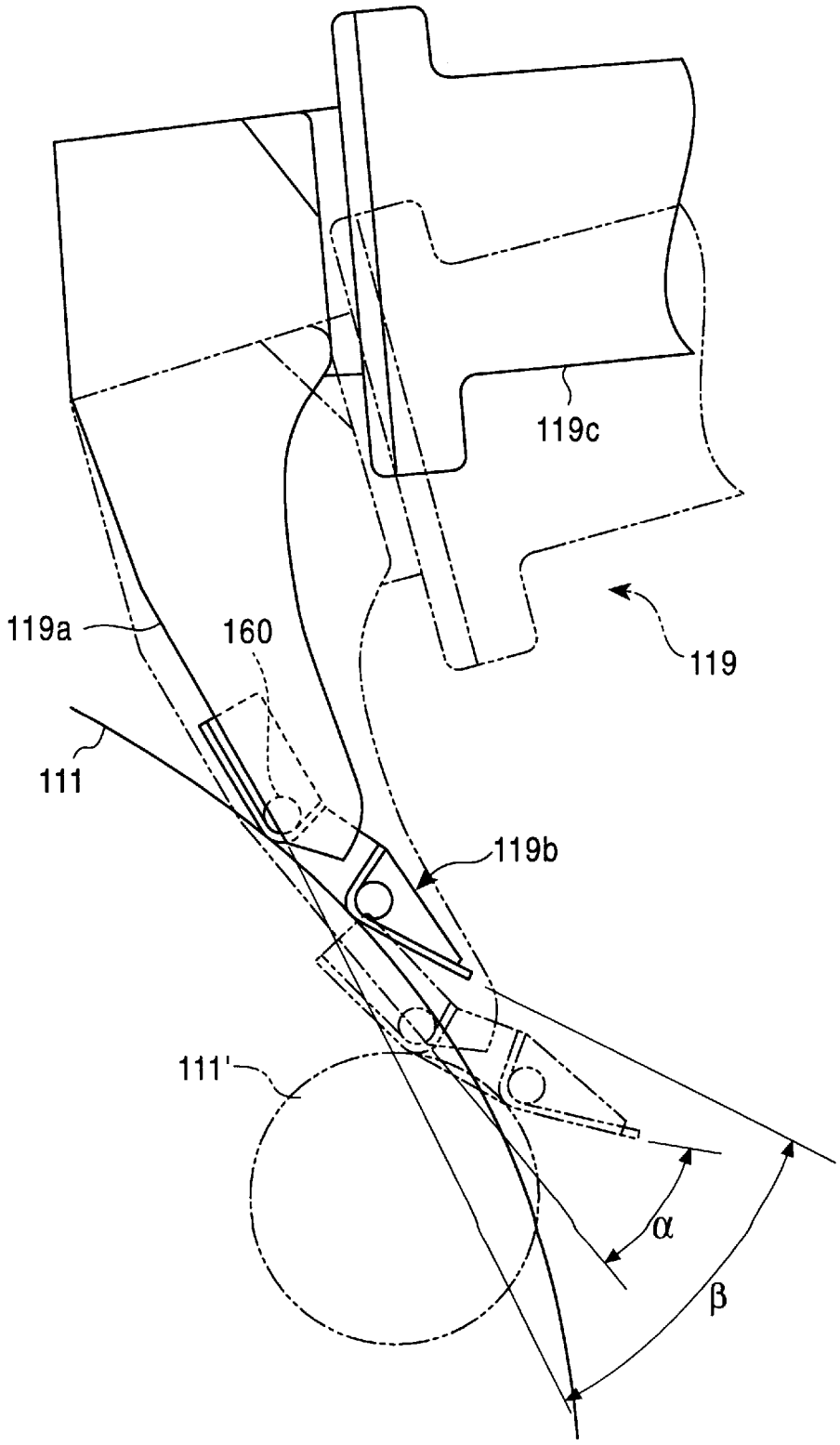
FIG. 15 is a diagram showing an end section of the compressed air type mouth, the position of which is adjusted in response to the size of the package diameter.

For example, FIG. 15 shows the air blowing mouth 119 rotated downwards, with the end section 119*b* abutting the yarn layer surface of the package 111 as yarn end retrieval is performed. The end section 119*b* of the air blowing mouth 119 indicated by the solid lines abuts the large-diameter package 111, forming angle $\beta$ with the mouth body 119*a*.

Alternatively, the end section 119*b* of the air blowing mouth 119 indicated by the chain-dotted line abuts a small-diameter package 111', forming angle $\alpha$, different from angle $\beta$ with the mouth body 119*a*.

Thus, the end section 119*b* of the air blowing mouth 119 can abut and stop the inertial rotation of the packages 111 of a variety of diameters by rotating against the mouth body 119*a* according to the size of the diameter of the package 111, thereby adjusting its position.

Additionally, retrieval of the yarn end can be performed regardless of the size of the diameter of the package 111.

Thus the air blowing mouth 119 can be used with the packages 111 of various diameters without any special modifications, and still manage to stop the inertial rotation of the package 111.

Comprised as thus described, the spinning frame operating cart of the present invention achieves the following results.

First, since the operating cart is provided with an air blowing type yarn end retrieving device which retrieves a yarn end by operating a compressed air flow against the yarn layer surface of a package, the need for blowers and driving motors required by conventional suction mouths to perform yarn end retrieval are obviated, the amount of space taken up by the machine can be reduced, energy costs can be economized, and the cost lowered.

Additionally, the air blowing yarn end retrieving device is equipped with a package braking function which forcibly stops the inertial rotation of the package, which can be employed stop the inertial rotation. Thus, a package brake is not required to stop the inertial rotation of the package, enabling the amount of space taken up by the spinning frame to be reduced, and the costs to be lowered.

Still further, since the end section of the air blowing yarn end retrieving device is attached so as to be rotatable against the mouth body, the position of the end section can be adjusted according to the size of the diameter of the package.

Thus, the air blowing yarn end retrieving device can both perform yarn end retrieval with the packages of various diameters without any special modification, and can further stop the inertial rotation of such packages.

What is claimed is:

1. An operating cart for a spinning frame which joins a yarn at a spinning unit when a yarn breakage occurs, comprising:

a package, provided in the spinning unit, having a yarn layer surface upon which spun yarn is being wound;

an air blowing yarn end retrieval device, for retrieving a yarn end, having an air blowing mouth pivotally connected to said operating cart, said air blowing mouth comprising a pair of oppositely arranged plate-shaped members, nozzles provided on surfaces of said plate-shaped members, and an opening section formed between said plate-shaped members at an end section of said air blowing mouth; and said end section of said air blowing mouth directing a compressed airflow ejected from said nozzle against the yarn layer surface of said package, so that the compressed airflow produces an accompanying airflow, which is pulled along with the compressed airflow and which increases its speed to merge with the compressed airflow and is discharged from said opening section, wherein said accompanying airflow, before merging with said compressed airflow, operates upon the yarn layer surface, and after merging, said compressed airflow operates upon the yarn layer surface, causing a yarn end to be lifted off the yarn layer surface.

2. The operating cart for a spinning frame as defined in claim 1, wherein said air blowing mouth of said air blowing yarn end retrieval device is pivoted to be lowered to contact the yarn layer surface of said package so as to forcibly stop an inertial rotation of said package.

3. The operating cart for a spinning frame as defined in claim 1 or 2, wherein said air blowing yarn end retrieving device includes a mouth body to which said end section rotatably connected, and said end section is adjustably positioned so as to abut the yarn layer surface of said package in response to a diameter of said package in close proximity to said end section.

* * * * *